United States Patent [19]

McCutchen

[11] Patent Number: 4,944,216

[45] Date of Patent: Jul. 31, 1990

[54] BUILDING EMERGENCY EXHAUST FAN SYSTEM

[76] Inventor: Wilmot R. McCutchen, 9 Sally Ann Rd., Orinda, Calif. 94563

[21] Appl. No.: 435,749

[22] Filed: Nov. 13, 1989

[51] Int. Cl.[5] ..... F24F 11/00

[52] U.S. Cl. ..... 98/33.1

[58] Field of Search ..... 98/33.1, 39.1, 42.03

[56] References Cited

U.S. PATENT DOCUMENTS

| | | | |
|---|---|---|---|
| 2,564,971 | 8/1951 | Harding | 98/40.03 |
| 3,817,161 | 6/1974 | Koplon | 98/39.1 |
| 3,884,133 | 5/1975 | Miller | 98/33.1 |
| 3,926,101 | 12/1975 | Moss | 169/60 X |
| 4,054,084 | 10/1977 | Palmer | 98/39.1 |
| 4,058,253 | 11/1977 | Munk et al. | 98/33.1 X |
| 4,068,568 | 1/1978 | Moss | 98/33.1 |
| 4,765,231 | 8/1988 | Aniello | 98/33.1 |

FOREIGN PATENT DOCUMENTS

| | | | |
|---|---|---|---|
| 639519 | 6/1950 | United Kingdom | 98/42.03 |

OTHER PUBLICATIONS

Uniform Building Code (1988), Extracts: Sect. 1807(a), (d), (e), (f), (g), (h), (i); Sect. 3310; app. 12, 13, 14, 15, 18.

Uniform Mechanical Code (1988), Extracts: Sect. 1102, 1104, 1105, 1106, 1107(a), 2001.

1989 Suppl. to the Uniform Building Code, Extracts: Sect. 1807(f) Revision; Sect. 3310(b) Revision.

Ashrae Symposium Papers Jun. 24–28, 1973, Louisville, Ky., pp. 34–40, "Ventilation Considerations for the Bart Transbay Tube" by Wilmot R. McCutchen.

*Primary Examiner*—Harold Joyce

[57] ABSTRACT

A process, for emergency use only, to exhaust smoke and gas from a fire source in the stationary structure of a building with a fan induced exhaust draft at or near the fire source. Actuation of exhaust fans at the roof of the building creates lowered air pressures in a volume of air within ducts leading to the fan inlets. This lowered air pressure in turn causes a draft of air from the building space near the fire source when a single intake to the ducts near the fire source is opened. The air velocity of the draft is sufficient to withdraw smoke and gas from the fire source into the ducts and through the fans to a discharge away from the building. The withdrawal of building air creates a partial vacuum near the fire source which is lower than atmospheric pressure and lower than any other air pressure in the building. Fresh, uncontaminated replacement air enters the building through intakes on the outside perimeter of the building and follows the pressure gradient created toward the fire source.

17 Claims, 2 Drawing Sheets

BUILDING EMERGENCY EXHAUST FAN SYSTEM

BACKGROUND—FIELD OF INVENTION

This invention is a process to exhaust smoke and gas from a fire source in a building by means of a fan-induced exhaust draft at or near the fire source.

BACKGROUND—DESCRIPTION OF PRIOR ART

A leading cause of deaths and injuries in building fires is the inhalation of toxic smoke and gas emitted from burning plastics, synthetic materials, and similar substances. Even if the flames are extinguished by automatic sprinklers or other methods, the smoke continues to permeate the interior of the building, making evacuation of occupants and operations of firefighters extremely hazardous. Firefighting efforts in multi-storied buildings are particularly hampered by possible smoke-filled elevator shafts.

Most local ordinances and building standards require special installations reserved strictly for emergencies or firefighting, such as smoke detectors, alarm systems, sprinkler systems, fire hose cabinets and hoses, standpipes, and escape routes from the building. There is, however, no comprehensive standard prescribed for a system that is adequate enough to exhaust smoke and gas from a building safely and that is reserved solely for emergency purposes. It is an object of this invention to describe such a system.

The officially approved practices for building emergency ventilation are contained in the Uniform Building Code (UBC) as adopted by local governmental agencies. Several provisions are made in this Code and the related Uniform Mechanical Code for smoke control, but for emergency situations reliance is placed both on natural ventilation by opening windows, treating shafts and stairwells as chimneys, or on mechanical ventilation to produce pressurized emergency stairwells, exhausting smoke through hatches at the roof. Other reliance is placed on so-called smoke-free enclosures such as ventilated vestibules and smoke barriers in the form of air-tight doors. Also, various means are prescribed for altering the normal building ventilation to prevent smoke from being carried from the fire to other parts of the building. Together with an approved automatic sprinkler system, the normal mechanical air-handling equipment may be designed to accomplish smoke removal directly to the outside at a minimum rate of one exhaust change each ten minutes for the area involved. This rate of air exhaust is not only entirely inadequate for emergency smoke situations, but the multiple intakes on the normal air-handling system are configured to spread smoke throughout the building area involved. The Uniform Mechanical Code specifies standards for exhaust hoods and ducts over commercial kitchen stoves under normal use, but such exhaust systems would also be inadequate for emergency situations elsewhere in the building.

The Uniform Building Code does allow any other approved design for smoke control, but does not specify the nature of such a process.

Patents issued show that inventors have generally followed the processes reflected in the UBC provisions; that is, methods to pressurize one area of a building such as an emergency stairwell or a corridor with respect to the fire source, or to convert the normal mechanical air-handling equipment into an exhaust only system. U.S. Pat. No. 4,054,084 to Palmer (1977) discloses a multiple array of supply fans and blowers in a stairwell intended to maintain a smoke and fire free escape from a multi-floor building. This is a complicated and mechanically unreliable means of isolating by variable pressurization only one part of the building, and the process leaves untreated the smoke in the building. U.S. Pat. Nos. 3,926,101 (1975) and 4,068,568 (1988) to Moss disclose means to maintain pressurized communal units relative to accommodation units in buildings, but does not adequately exhaust smoke from the buildings. U.S. Pat. Nos. 4,765,231 to Aniello (1988), 4,058,253 to Monk (1977), and 3,884,133 to Miller (1975) disclose versions of converting existing normal ventilating or air-handling and conditioning systems with their branches and return air ducts into inadequate emergency air and smoke exhaust systems, with multiple intakes that spread the smoke throughout the area involved in a fire.

OBJECTS AND ADVANTAGES

Several objects and advantages of the present invention are:

(a) to provide a reliable fire and life safety building emergency smoke and gas removal system dedicated solely for that purpose and which removes smoke and gas from their source;

(b) to provide quantities of air flow sufficient to control and exhaust smoke and other products of combustion safely from the building and to prevent contamination of other parts of the building;

(c) to provide, with fresh outside air, air pressures in the fire-affected areas of the building that are higher than the pressure at the source of fire gases and smoke;

(d) to provide safe and smoke free evacuation routes for building occupants and rapid, smoke free routes of access for fighters to approach the fire source;

(e) to provide redundancy in mechanical equipment, power supply, and activation and control means to ensure reliability of emergency operation;

(f) to provide an emergency exhaust fan system which can be installed in either new or existing buildings;

(g) to provide an emergency exhaust fan system which can be installed to meet hazardous smoke and gas removal needs in any building, including but not limited to multi-story or high-rise buildings, office buildings, hotels and lodging houses, apartment houses, wholesale and retail stores, factories and workshops, storage and sales rooms for combustible goods, hospitals, nursing homes, mental hospitals, and jails.

Further objects and advantages are to provide a simple and uniform method, based on sound scientific principles, which can supplant the present miscellany of ineffective Uniform Building Code standards and criteria for smoke emergency ventilation. Still further objects and advantages will become apparent from a consideration of the ensuing description and drawings.

DRAWING FIGURES

Reference Numerals in Drawings

10—Main vertical exhaust duct
12—Emergency exhaust fan
14—Feeder duct (in furred ceiling space)
16—Exhaust air intake with smoke detector for Fire Zone A
18—Exhaust air intake with smoke detector for Fire Zone B
20—Exhaust air intake with smoke detector for Fire Zone C
22—Fresh air intake, emergency stairwell
24—Fresh air intake, elevator shaft
26—Elevator shaft
28—Fresh air intake, main vertical exhaust duct
30—Furred ceiling (cut-away)
32—Corridors or common passageways
34—Emergency exit doors to emergency stairwells
36—Elevator door
38—Room door
40—Example location of fire smoke source
42—Path of smoke caused by emergency fan system
44—Path of fresh air caused by emergency fan system
46—Outside line of building
48—Building ground line

DESCRIPTION—FIGS. 1, 2, AND 3.

Figure 1:
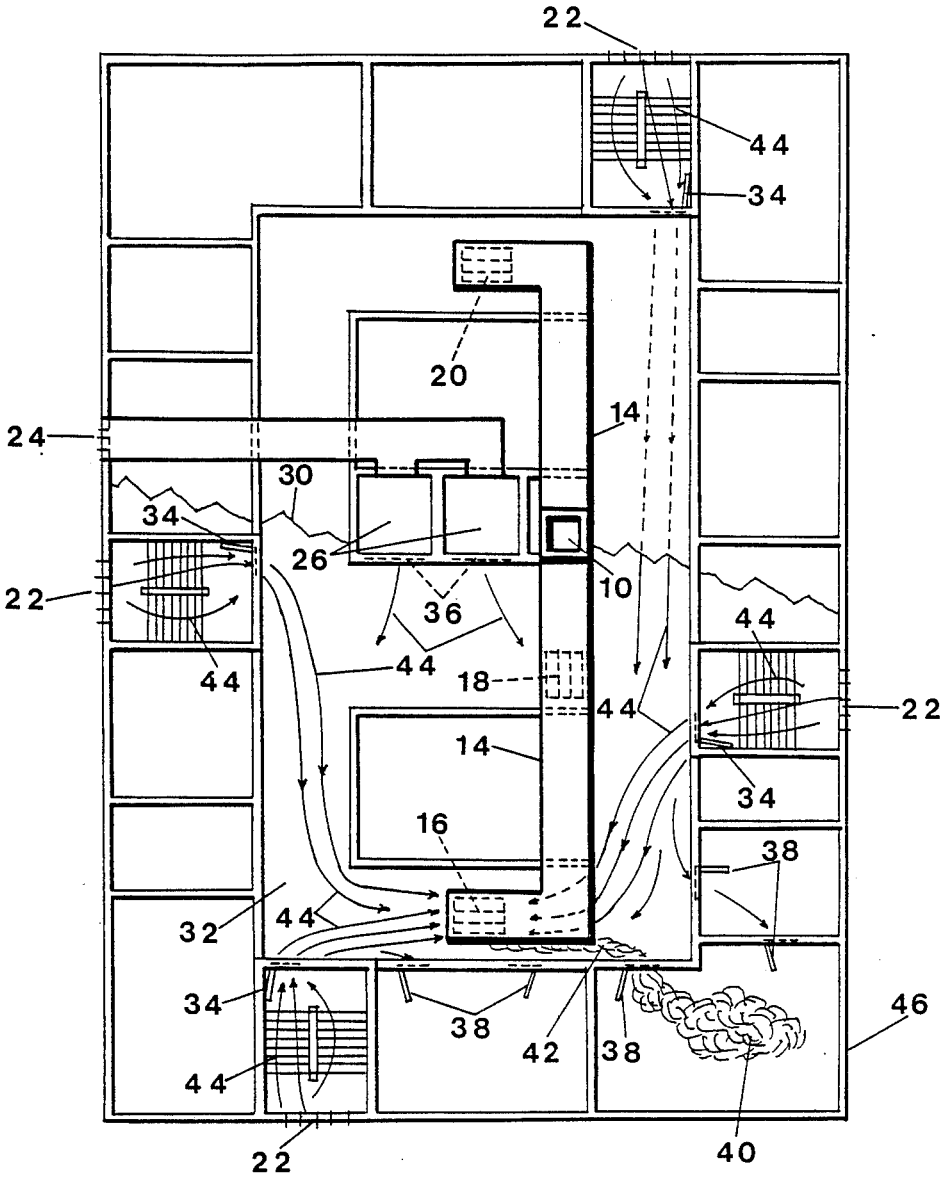
FIG. 1 shows a floor and ceiling layout of the story in a building affected by the fire smoke occurrence and the exhaust air and fresh air streams produced by the emergency fan system in an example of such a fire smoke occurrence.

FIG. 1 shows a typical floor and ceiling layout for a story in a building with the portion of the emergency exhaust fan system pertaining to that story in place. Feeder ducts 14 in the furred ceiling space lead to the main vertical exhaust duct 10, which connects to the inlets of two large exhaust fans at the roof level. FIG. 1 shows an example configuration of two feeder ducts 14 having exhaust air intakes 16, 18, and 20 in the ceiling of corridors 32 and centrally situated within assigned and identified fire zones for the entire floor space. Additional feeder ducts and intakes of the same size are provided if needed for larger floor spaces. The fire zone boundaries are set on the basis of which exhaust air intake can serve the particular zonal area most effectively. Approved devices known as smoke detectors, that sense visible or invisible particles of combustion, are placed adjacent to each exhaust air intake and are identified with the zone and intake identification. These smoke detectors are also installed in places required by the Uniform Building Code and in each separate room within the fire zones.

FIG. 1 also shows emergency exit doors 34, which lead directly to the outside of the building for a one-story building and thus provide a set of fresh air intakes for the emergency exhaust fan system. In the case of a multi-story building, the emergency exit doors 34 lead to stairwells and to fresh air intakes 22. These intakes are openings in the walls to the outside with either fixed louvers or dampers which can be mechanically controlled to open by remote direction from the building central control station. Fresh air intakes 22 are provided near the top and bottom of each stairwell. For buildings over ten stories high, additional fresh air intakes are provided at mid-story level and at every ten story interval. For multi-story or high-rise buildings with elevators, additional fresh air intakes 24 and ducts are provided leading to each elevator shaft 26 at approximately mid-level height of the building, as shown in FIG. 1.

Figure 2:
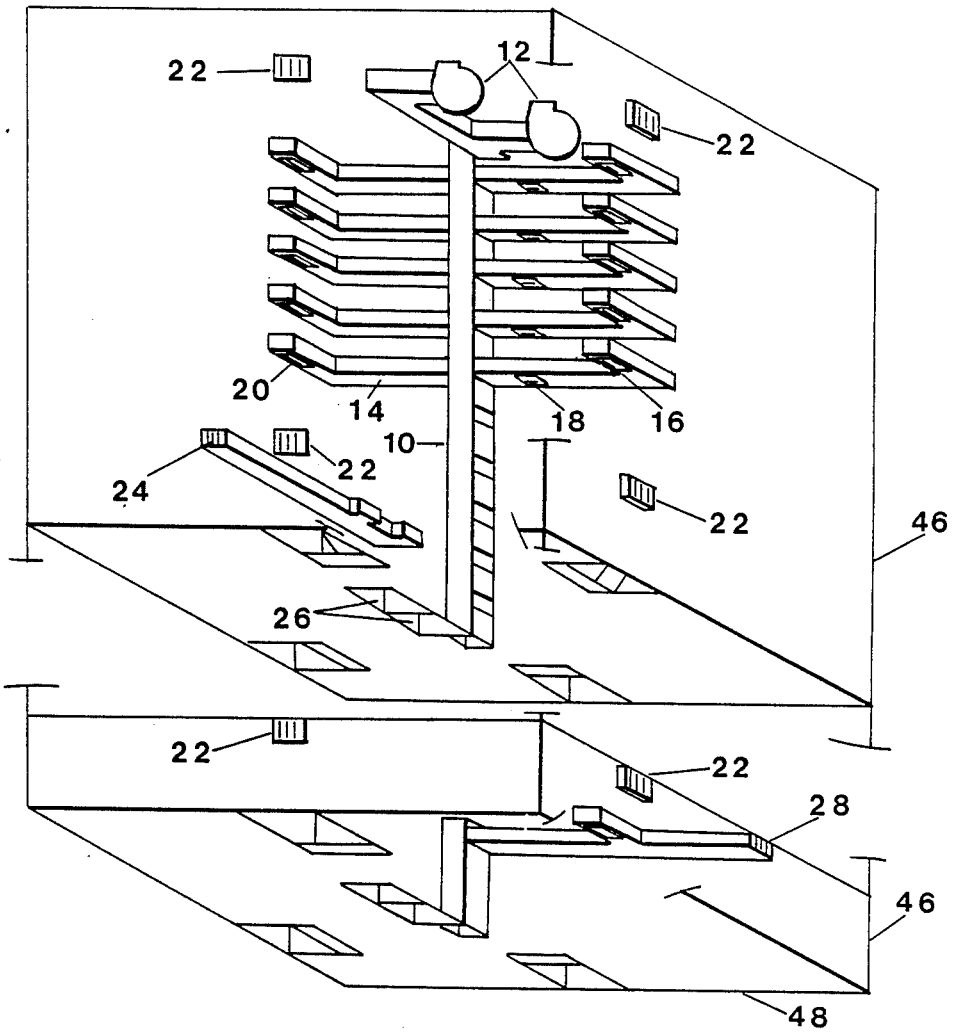
FIG. 2 shows a partial schematic riser diagram of the emergency exhaust fan system in a multi-story or high-rise building.

FIG. 2 shows the extent of the main vertical exhaust duct 10 and its connection in parallel to the two emergency exhaust fans 12 located in the utility room at roof level. The discharge from these fans is as remote as possible from and not less than 12 m from any fresh air intake 22 and from any building vent. The main vertical exhaust duct 10 connects to feeder ducts 14 at each story and extends past the building ground line 48 to the lowest basement level ceiling. To prevent fan overload, a fresh air intake 28 to the main vertical exhaust duct 10 near ground level has dampers which open automatically when the fans start up. As soon as an exhaust air intake opens, the fresh air intake 28 closes automatically. FIG. 2 also shows the locations of fresh air intakes 22 and 24 at the outside of the building 46.

Figure 3:
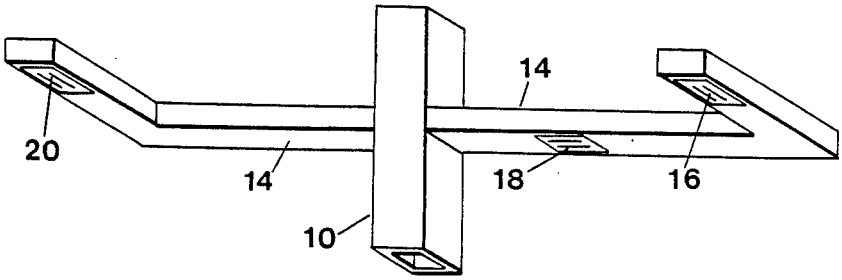
FIG. 3 shows a detail of the feeder ducts of FIG. 2 connected to the main vertical exhaust duct together with the exhaust air intakes in the feeder ducts.

FIG. 3 is a detail view of the main vertical exhaust duct 10 shown in FIG. 2 along with the connecting feeder ducts 14 for one story of a high-rise building. The exhaust air intakes 16, 18, and 20 are positioned at the furred ceiling height in corridors and near the centers of the fire zones which they serve.

FIGS. 1 and 2 show the main vertical exhaust duct 10 adjacent to but fire and air separated from the elevator shafts 26. This is only one possible configuration. For installation in existing buildings, the main vertical exhaust duct 10 can be in an existing stairwell or be placed on the outside of the building, with feeder ducts penetrating to the appropriate fire zones and exhaust air intakes within the building.

At the building central control station required by the Uniform Building Code (UBC), at least two separated control circuits can each operate the emergency fans 12, exhaust air intakes 16, 18, and 20 for each story, fresh air intakes 22, 24, and 28, and give status indications and floor and zone identification for all smoke detectors. All elements of the emergency exhaust fan system connect to the standby power source required by the UBC.

When operating alone, each emergency exhaust fan 12 has enough capacity to produce a minimum required velocity of air flow in the corridors 32 adjacent to a single opened exhaust air intake ( 16 in the example shown in FIG. 1), with all other intakes closed. This minimum velocity is sufficient to control fire smoke from a fire source within the zone of the open intake and to direct all the smoke and other products of combustion into the feeder duct 14. In an unobstructed corridor, this velocity should be about 100 m/min, enough also to guide persons evacuating from this area of the building. When both fans 12 are operating in parallel, the maximum velocity in an occupied corridor 32 should not be so high as to make walking difficult or to induce panic. This maximum velocity should be about 325 m/min.

The sizing of the main vertical exhaust duct 10, feeder ducts 14, exhaust air intakes 16, 18, and 20, fresh air intakes 22, 24, and 28 is determined on the specific building configuration and on the combination of air flow resistances which cause the exhaust fans 12 to operate at or near peak efficiency.

Emergency exit doors 34 and room doors 38 are not air tight or self-closing but permit air flow of more than negligible amounts even when completely shut. Also, both these types of doors can be fixed in the open position when opened. Elevator doors 36 also permit passage of air through and around them.

Because smokeproof enclosures as specified in the Uniform Building Code interfere with the efficient operation of the emergency fan air flow process, they become unecessary and unwanted when the building emergency fan system is installed. The vestibules which are part of the smokeproof enclosure have actually a net negative pressure away from the fire source. This negative pressure would tend to draw smoke toward the vestibule and would compete with the emergency fans 12 in drawing smoke from the building. Also, the vestibules would block fresh air intake and hinder evacuation. Likewise, pressurized stairwells, which are another part of the smokeproof enclosures, tend to put atmospheric pressure levels within the building, thus competing with the action of the emergency exhaust fans in lowering pressures in the fire area and beyond to less than atmospheric. A horizon of atmospheric pressure within the building area affected by the fire permits the spread of smoke. The elimination of these costly smokeproof enclosures will help to offset some of the cost of installation of the building emergency exhaust fan system.

OPERATION—FIGS. 1 AND 2.

FIG. 1 shows an example of fire and smoke occurrence 40 in a room on a mid-level floor of a high-rise building. The room occupants or the smoke detectors, or both, detect the smoke and give the alarm to the central control station by established communication means. The detection and alarm sequence includes identification of the floor and fire zone of the fire smoke occurrence. The central control station authority starts the emergency exhaust fans either by manual switch or by an automatic process through the smoke detection, alarm, and emergency fan communication and control system. Also, either manually or automatically, the control station authority opens the one proper exhaust air intake 16 and all fresh air intakes 22 and 24.

FIG. 1 shows that for a fire smoke source 40, exhaust air intake 16 is the proper one to be open. One and only one exhaust air intake is open at any one time; all others remain tightly shut. The normal ventilating and air-conditioning system in the building is off.

FIG. 1 also shows the air flows resulting from the actuation of the building emergency fan system. The fans create a lowered air pressure in the volume of air within the main vertical exhaust duct 10 and feeder ducts 14 as part of the air originally in these ducts is pumped out by the fans. This lowered air pressure in turn causes a flow of air or draft with significant velocity into the feeder duct 14 when the single exhaust air intake 16 opens. Building air near the fire source 40, including the air mixed with smoke and other products of combustion 42, flows through the exhaust air intake 16, the feeder duct 14, the main vertical exhaust duct 10, and the emergency exhaust fans 12 (shown in FIG. 2) to a safe discharge area outside the building.

The withdrawal of building air from near the fire source creates a lowered pressure, or partial vacuum with respect to atmospheric pressure, in the volume of air in the vicinity of the fire smoke source 40. As the normal building ventilation and all exhaust air intakes 18 and 20 on the fire floor and other exhaust air intakes in the building remain nonoperative or closed off, the lowest air pressure in the occupied area of the building is at the exhaust air intake 16. The withdrawal of building air through the exhaust air intake 16 produces a gradient of negative air pressures in the corridors 32 and adjacent rooms rising from the lowest pressure at the exhaust air intake 16 to atmospheric pressure away from the fire smoke source. This pressure gradient permits the influx of abundant quantities of fresh, uncontaminated air 44 into the corridors 32 through the open fresh air intakes 22 and 24 and through the emergency exit doors 34 and elevator doors 36. The process of evacuation of building occupants and the opening of doors connected therewith helps the inflow of fresh air. The velocities of fresh air flow 44 in the corridors 32 near the fire smoke source are sufficient to control the smoke, to prevent its propagation through the occupied areas of the building, and to withdraw it completely through the exhaust air intake 16.

Consequently, building occupants on the fire floor can make their way out through designated emergency exits in complete safety, with fresh air initially blowing in their faces to direct them along an emergency exit path. Elevators in multi-story buildings return to the ground floor and revert to manual control as presently required by the Uniform Building Code. Thereafter, in contrast to present practice, the elevators can be used by firefighters because the elevator shafts are paths of incoming fresh air, at a higher air pressure than the air pressure at the fire smoke source. The use of elevators in multi-story buildings greatly assists fire-fighting personnel in reaching the fire floor quickly, in evacuating building occupants with impaired mobility, and in carrying out prompt fire suppression measures.

Although the draft of fresh air produced by the emergency exhaust fan system supports the combustion at the fire smoke source, it also carries away heat from the combustion into the exhaust system, thereby aiding in the reduction of heat build-up and in the prevention of flashovers. Therefore firefighters can not only approach the fire along a smoke free path but they can approach along a cooler path.

As building occupants exit from other floors of a high-rise building, air flows from those floors into the stairwells and then onto the fire floor. This air circulation contibutes to, but does not detract from, the fresh air intake quality, since the normal ventilation system in the building is shut down and closed off and does not inadvertently introduce contaminated air into the fresh air stream.

By using only one opened exhaust air intake and by shutting off the normal building ventilation system, the steepest pressure gradient toward the fire source is realized. In case the wrong exhaust air intake is opened initially, it should be closed as soon as the correct exhaust air intake is opened. Otherwise, if the two exhaust intakes are open, smoke and gas will diffuse within the building between these competing intakes.

CONCLUSIONS, RAMIFICATIONS, AND SCOPE OF INVENTION

The foregoing specification describes a simple, reliable, safe, and scientifically sound process to remove hazardous smoke and gaseous emissions caused by a fire emergency in any building, new or existing, single or multi-story. The process can be applied to a building used for any of many purposes, including but not limited to offices, hotel rooms, apartments, wholesale and retail stores, factories and workshops, hospitals, nursing homes, and jails. Further advantageous features of the process are:

It removes smoke and gas from near the fire and smoke source, thus preventing the spread of hazardous substances throughout the building.

It serves as a process using equipment installed and sized strictly for emergency purposes and does not use conversions of the normal ventilation or air-conditioning equipment in the building.

It provides reliable, safe, and smoke free evacuation routes for building occupants and rapid, smoke free access routes for firefighters.

It makes unecessary the costly and unpredictable methods of preventing smoke intrusions as prescribed in current building regulations, such as smokeproof vestibules and pressurized stairwells.

Although the description above contains many specificities, these should not be construed as limiting the scope or configuration of the invention but as merely providing illustrations of some of the preferred embodiments of the process. For example, the process may be applied to any number of configurations of buildings and fire sources than the example shown.

Thus the scope of the invention should be determined by the appended claims and their legal equivalents, rather than by the examples given.

I claim:

1. A process, reserved for emergency purposes only, for safely evacuating smoke and gaseous emissions caused by a fire from anywhere within the occupied area of a building and simultaneously drawing fresh air into said building to replace the withdrawn smoke and gas, said building comprising a roof and enclosing outer perimeter walls, and one or more stories, each story comprising a floor and a ceiling, at least one entrance, at least one emergency exit leading directly to the outdoors, and an interior space subdivided into a plurality of zones, comprising the steps of:

(a) detecting and identifying, by smoke detection means, the presence of a smoke and gas source, and the location of a story and a zone within said story containing said smoke and gas source; and (b) actuating, by remote control means, one or more emergency exhaust fans near the roof of said building to create significantly lower than atmospheric pressures within a main vertical exhaust duct connected to the inlet of said emergency exhaust fans; and (c) opening, by remotely controlled damper means, a single exhaust air intake connected to said main vertical exhaust duct by means of a feeder duct, said exhaust air intake being located within the zone containing said smoke and gas source and away from any of said entrances and said emergency exits, to create a draft and directed stream of air with a velocity sufficient to carry said smoke and gaseous emissions from the occupied area of said building and to overcome the natural ventilation currents caused by said fire and to withdraw said smoke and gaseous emissions through said main vertical exhaust duct and said exhaust fan to a safe discharge location outside of said building; and (d) opening said entrance and said emergency exit to said story to admit a flow of fresh and uncontaminated air toward the partial vacuum created at said smoke and gaseous emissions source.

2. The process of claim 1 wherein the building includes more than one story, including any basement stories, and a plurality of emergency exits at each story leading to emergency exit stairwells extending throughout the building height, further including the step of opening, by remotely controlled louver means, fresh air intakes leading into said emergency exit stairwells, to admit a flow of fresh and uncontaminated air through said emergency exit stairwells and said emergency exits at the story containing said fire and toward said partial vacuum thus created in the vicinity of said smoke and gaseous emissions source, said fresh air intakes being located in the outside perimeter walls of said building at the ground level story, near the mid-height story, at approximately each tenth story interval, and near the uppermost story level.

3. The process of claim 2 wherein said building contains one or more elevator shafts extending throughout the building height, and elevator shaft doors for each elevator shaft at each story level, further including the step of opening, by remote control means, one or more louvered fresh air intakes located near the mid-height of said building to admit an additional flow of fresh and uncontaminated air through a duct connecting said fresh air intake with each of said elevator shafts and thence through and around said elevator shaft doors at the story containing said fire and toward said partial vacuum thus created in the vicinity of said smoke and gaseous emissions source.

4. A combination including a building having at least one story of useable space, wherein the story includes a floor, a ceiling, enclosing walls, at least one entrance, at least one emergency exit to an outside space, a plurality of zones subdividing each story space, and an emergency use system for safely withdrawing smoke and gas from the building and simultaneously drawing fresh air into the building to replace the withdrawn smoke and gas, said emergency use system comprising:

(a) at least one emergency fan having an air inlet and an air exhaust outlet in communication with a space outside of the building;

(b) at least one main vertical exhaust duct having two ends wherein one end is connected to the inlet of each emergency fan and the other end extends through the lowermost story of the building and terminates as a closed end therein;

(c) a plurality of feeder ducts located in each story of the building and each of said feeder ducts having two ends, wherein one end is connected to the main vertical exhaust duct and is in communication with the space within said main vertical exhaust duct and the other end is closed and terminates in one of the zones of the story space, whereby at least one feeder duct is located in each zone of each story of the building;

(d) an exhaust air intake to each of said feeder ducts located near the center of the zone in which the feeder duct terminates and away from any entrance and exit and having damper means and remote control means whereby the normally closed exhaust air intake may be opened in an emergency and whereby the feeder duct is brought in communication with the story space;

(e) at least one smoke sensing device located in each zone whereby the building authority is assisted in determining the presence of and location of the smoke source by story and zone identification within the building;

(f) a remote control means for turning on the emergency fan and simultaneously opening the exhaust air intake in the zone where smoke is detected resulting in smoke and gas being exhausted through the feeder duct and the main vertical exhaust duct and through the emergency fan and through the emergency fan outlet to an area outside the building and at the same time resulting in fresh and uncontaminated air being drawn toward the smoke source through each entrance and exit to the story containing the smoke source; and (g) a primary electric power means to energize the emergency use system including the emergency fan means, damper means, smoke sensing means, and remote control means.

5. The combination of claim 4 further including an alarm transmission means for alerting appropriate authorities as to the presence and location by story and zone in the building of smoke, wherein the alarm is connected to and responsive to the actuation of each smoke sensing device.

6. The combination of claim 4 further including an auxiliary electric power means for providing power in the event the primary power to the remote control means, damper means, smoke sensing means, and the emergency fan means have insufficient electric power to operate.

7. The combination of claim 4 wherein the main vertical exhaust duct of the emergency use system further includes:

(a) at least one fresh air intake duct having two ends wherein the first end is in communication with air exterior to the building, said first end having moveable louvers and remote control operating means, and the other end is connected to and in communication with the main vertical exhaust duct whereby the louvers being normally open fresh air passes into the main vertical exhaust duct to prevent fan overload by supplying air for fan operation during the time interval between starting the emergency fan and opening of the exhaust air intake in the zone containing the smoke and gas source; and (b) a connection of said remote control operating means to said primary electric power means and to an auxiliary power source whereby said moveable louvers may be moved to the closed position simultaneously upon opening of any exhaust air intake.

8. The combination of claim 4 wherein the building further includes one or more basement stories, one or more stairwells containing stairs between adjacent stories, said stairwells having emergency exit openings into each story, and wherein the emergency use system further comprises:

(a) a fresh air intake duct having two ends wherein the first end is in communication with the air external to the building and the other end terminates in and is in communication with the space in said stairwell; and (b) a plurality of moveable louvers in said fresh air intake duct connected to the remote control means whereby when smoke is detected the louvers are opened at the same time the emergency fan is turned on and the exhaust air intake in the zone of smoke occurrence is opened resulting in air from outside the building flowing through the louvered openings in said fresh air intake duct, through the stairwell, through the emergency exit opening into the story containing the detected smoke and toward the zone with the detected smoke while at the same time the smoke is being drawn through the feeder duct, up through the main vertical exhaust duct and out the building.

9. The combination of claim 8 wherein the building includes a plurality of stories and one or more emergency stairwells extending throughout the building height, and wherein the emergency use system further comprises:

(a) a fresh air intake at the ground level story in communication with the emergency stairwell;

(b) a fresh air intake at approximately mid-height of the building in communication with the emergency stairwell;

(c) a fresh air intake located near the uppermost story height of the building in communication with the emergency stairwell; and (d) a fresh air intake at approximately each tenth story of height of the building in communication with the emergency stairwell.

10. The combination of claim 4 wherein the building includes at least one elevator shaft having elevator shaft doors on each story and the emergency use system further comprises:

(a) at least one fresh air intake duct having two ends wherein one end is in communication with the air exterior to the building and the other end is in communication with the elevator shaft space and terminates therein; and (b) a plurality of moveable louvers in the intake duct connected to the remote control means whereby when smoke is detected the louvers are opened at the same time the emergency fan is turned on resulting in exterior air flowing into and through said fresh air intake duct and through the elevator shaft and elevator shaft doors toward the zone with the detected smoke while the smoke is being drawn away through the feeder duct, the main vertical exhaust duct, and out the building so that smoke is prevented from spreading toward the elevator shaft.

11. The combination of claim 10 wherein the main vertical exhaust duct is located in the elevator shaft and extends along the length of the elevator shaft.

12. The combination of claim 4 wherein the main vertical exhaust duct is located on the exterior wall of the building.

13. The combination of claim 8 wherein the main vertical exhaust duct is located in the stairwell.

14. The combination of claim 4 wherein one or more feeder ducts extend to more than one zone and have exhaust air intakes located in each zone.

15. A system, reserved for emergency use only, to withdraw safely smoke and gas caused by a fire from anywhere in the structure of a building having one or more entrances near ground level, one or more basement stories, a roof, a perimeter enclosing structure, one or more elevator shafts, one or more emergency stairwells, and a plurality of stories each having a floor, a ceiling, at least one entrance, at least one exit to the emergency stairwell, elevator shaft doors, and an interior space subdivided into zones, said system comprising:

(a) at least one emergency fan located near the roof of the building and having an air inlet and an air exhaust outlet in communication with a space outside of the building;

(b) a main vertical exhaust duct having two ends wherein one end is connected to the inlet of each emergency fan and the other end extends vertically through the lowermost basement story of the building and terminates as a closed end therein;

(c) a feeder duct located in each zone of each story and having two ends, wherein one end is connected to the main vertical exhaust duct and is in communication with the space within said main vertical exhaust duct and the other end is closed and terminates in said zone;

(d) an exhaust air intake to said feeder duct located near the center of the zone containing said feeder duct and away from any entrance and exit and having damper means and remote control means whereby the normally closed exhaust air intake may be opened in event of smoke occurrence in the zone containing said exhaust air intake and whereby said feeder duct is then brought in communication with the story space near said smoke occurrence;

(e) at least one smoke detecting device located in each zone whereby the building authority is assisted indetermining the presence of and location of the smoke source by story and zone identification within the building;

(f) an alarm transmission means for alerting the appropriate authorities as to the presence of and location in the building of smoke, wherein the alarm is connected to and responsive to the actuation of each smoke detecting device;

(g) a plurality of fresh air intakes connecting by air passage means through the building perimeter enclosing structure the space exterior to the building with the emergency stairwell, wherein said fresh air intakes are located at the ground level story, near the uppermost story level, and near each tenth story interval intermediate thereto;

(h) a plurality of louvers for each of said fresh air intakes having remote control means whereby the louvers may be opened in the event of smoke occurrence in the building;

(i) air passage means in the door at the exit to the emergency stairwell on each story whereby a significant draft of air may pass through the exit to the emergency stairwell when said door is in a closed position;

(j) at least one fresh air intake duct having two ends wherein one end is in communication with the air exterior to the building and the other end is in communication with the elevator shaft space and terminates therein;

(k) remote control means for turning on the emergency fan and at the same time opening the exhaust air intake in the zone where smoke is detected and opening all of the fresh air intake louvers resulting in smoke and gas being exhausted into the feeder duct and being prevented from permeating the building story space and instead being drawn through the main vertical exhaust duct and the emergency fan to a safe discharge outside the building and at the same time resulting in fresh and uncontaminated air being admitted through building entrances and the fresh air intakes and through the emergency stairwell and the elevator shaft and elevator shaft doors and exits and entrances to the story containing the smoke occurrence and then being conveyed toward said zone where smoke is detected;

(l) a primary electric power means to energize said system, including emergency fan operating means, exhaust air intake damper means, fresh air intake louver means, smoke detecting means, alarm transmission means, and remote control means; and (m) an auxiliary power means for providing electric power in the event said primary electric power means becomes insufficient for full system operation.

16. The system of claim 15 wherein the main vertical exhaust duct further includes air passage means near ground level, including louver means and remote control means, between the space outside the building and the space within said main vertical exhaust duct, whereby the normally open louver means allows air to be fed to the emergency fan during initial operation of said emergency fan and whereby said air passage means may be closed said louver means and said remote control means when any of the exhaust air intakes are opened.

17. The system of claim 15 wherein the fresh air intake duct in communication with the elevator shaft space further includes louver means and remote control means whereby the normally closed louver means may be opened by said remote control means when said emergency fan is turned on.

* * * * *